US005724682A

United States Patent [19]

Johnson

[11] Patent Number: 5,724,682

[45] Date of Patent: Mar. 10, 1998

[54] TOILET VENTILATION SYSTEM

[76] Inventor: Steven Johnson, R.R. 1 Box 154A, Puposky, Minn. 56667

[21] Appl. No.: 711,689

[22] Filed: Sep. 5, 1996

[51] Int. Cl.[6] ..... A47K 13/00

[52] U.S. Cl. ..... 4/217; 4/213

[58] Field of Search ..... 4/217, 209 R, 4/213, 240, 236

[56] References Cited

U.S. PATENT DOCUMENTS

| | | | |
|---|---|---|---|
| 988,273 | 3/1911 | Levenhagen et al. . | |
| 1,173,520 | 2/1916 | Hunter | 4/217 |
| 2,696,619 | 12/1954 | Ring | 4/217 |
| 2,728,088 | 12/1955 | Gudish | 4/217 |
| 3,108,289 | 10/1963 | Smith | 4/213 |
| 3,790,970 | 2/1974 | Bendersky et al. | 4/217 |
| 3,916,459 | 11/1975 | Ivancevic | 4/213 |
| 4,175,293 | 11/1979 | Stephens et al. | 4/209 |
| 4,251,888 | 2/1981 | Turner | 4/217 |
| 4,780,913 | 11/1988 | Williams | 4/217 |
| 5,136,730 | 8/1992 | Casale | 4/213 |

*Primary Examiner*—David J. Walczak
*Attorney, Agent, or Firm*—Merchant, Gould, Smith, Edell, Welter & Schmidt, P.A.

[57] ABSTRACT

A toilet seat defining an inner duct and including a plurality of ventilation apertures in fluid communication with the inner duct. The seat includes first and second generally co-axially aligned pivot members that are integrally formed with the back end of the toilet seat and extend laterally outward from opposite sides of the seat. The pivot members define axial openings in fluid communication with the inner duct. Left and right bracket members define pivot holes through which the first and second pivot members extend to pivotally mount the toilet seat on the toilet bowl. A removable plug is inserted within the axial opening of the first pivot member. A ventilation conduit provides fluid communication between the axial opening of the second pivot member and a source of vacuum. A swivel structure provides a generally fluid tight connection between the ventilation conduit and the second pivot member and is constructed and arranged to allow the toilet seat to pivot with respect to the ventilation conduit.

4 Claims, 2 Drawing Sheets

TOILET VENTILATION SYSTEM

FIELD OF THE INVENTION

The present invention relates generally to ventilation systems. More particularly, the present invention relates to ventilation systems for removing unpleasant odors from toilet bowls.

BACKGROUND OF THE INVENTION

A variety of ventilation systems have been employed to dissipate unpleasant odors within lavatory facilities. Most commonly, ceiling fans are used to continuously withdraw air from the lavatory. However, such ceiling fans only ventilate unpleasant odors after they have already had the opportunity to diffuse throughout the lavatory. Consequently, even with operable ceiling fans, objectionable odors are still present in lavatories. Furthermore, such ceiling fans are relatively inefficient because they must continuously ventilate large volumes of air from the entire lavatory.

Efforts have been made to provide ventilation systems that solve the aforementioned problems associated with ceiling fans by ventilating air directly from a toilet bowl. However, such ventilation systems typically are very complicated and include many parts. Consequently, such ventilation systems are expensive and difficult to assemble. Furthermore, such ventilation systems are not very adaptable and typically cannot easily be mounted on varying styles of toilet bowls.

What is needed is a simple, inexpensive, adaptable, and easy to install ventilation system that can be used to easily retrofit existing toilet facilities.

SUMMARY OF THE INVENTION

The present invention relates to a toilet ventilation system including a toilet seat having an inner duct defined therein. The toilet seat includes a plurality of ventilation apertures extending between the inner duct and a bottom surface of the toilet seat. First and second generally co-axially aligned pivot members are integrally formed with a back end of the toilet seat. The first and second pivot members extend laterally outward from opposite sides of the toilet seat and define axial openings in fluid communication with the inner duct. The toilet ventilation system also includes first and second bracket members through which the first and second pivot members respectively extend to pivotally mount the toilet seat on a toilet bowl. A removable plug is inserted within the axial opening of the first pivot member while a ventilation conduit connects the axial opening of the second pivot member to a source of vacuum. A swivel structure provides a generally fluid tight connection between the ventilation conduit and the second pivot member. The swivel structure is constructed and arranged to allow the toilet seat to pivot relative to the ventilation conduit.

In general use, the source of vacuum provides suction to the ventilation apertures. The suction at the ventilation apertures draws air from the toilet bowl through the ventilation apertures into the inner duct. The air then travels from the inner duct through the axial opening in the second pivot member to the ventilation conduit. The ventilation conduit preferably carries the air outside the building or to existing building vent lines.

The present invention also relates to a toilet ventilation kit for retrofitting a toilet bowl. The kit includes a toilet seat having an inner duct and a plurality of ventilation apertures extending between the inner duct and a bottom surface of the toilet seat. The toilet seat also includes first and second co-axially aligned pivot members integral with a back end of a toilet seat and extending laterally outward from opposite sides of the toilet seat. The first and second pivot members define axial openings in fluid communication with the inner duct. The kit also includes first and second bracket members for pivotally mounting the toilet seat on the toilet bowl. Furthermore, the kit includes a ventilation conduit for providing fluid communication between the axial opening of one of the pivot members and a source of vacuum, and a removable plug for insertion within the axial opening of the other pivot member.

It will be appreciated that the present invention provides a toilet ventilation system that has a minimal number of parts, is inexpensive to manufacture, and is easy to install. Furthermore, the design of the toilet ventilation system allows the ventilation tube to be mounted on either the left or right hand side of the toilet bowl thereby facilitating installing the ventilation system.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE PREFERRED EMBODIMENT

Reference will now be made in detail to exemplary embodiments of the present invention which are illustrated in the accompanying drawings. Wherever possible, the same reference numbers will be used throughout the drawings to refer to the same or like parts.

Figure 1:
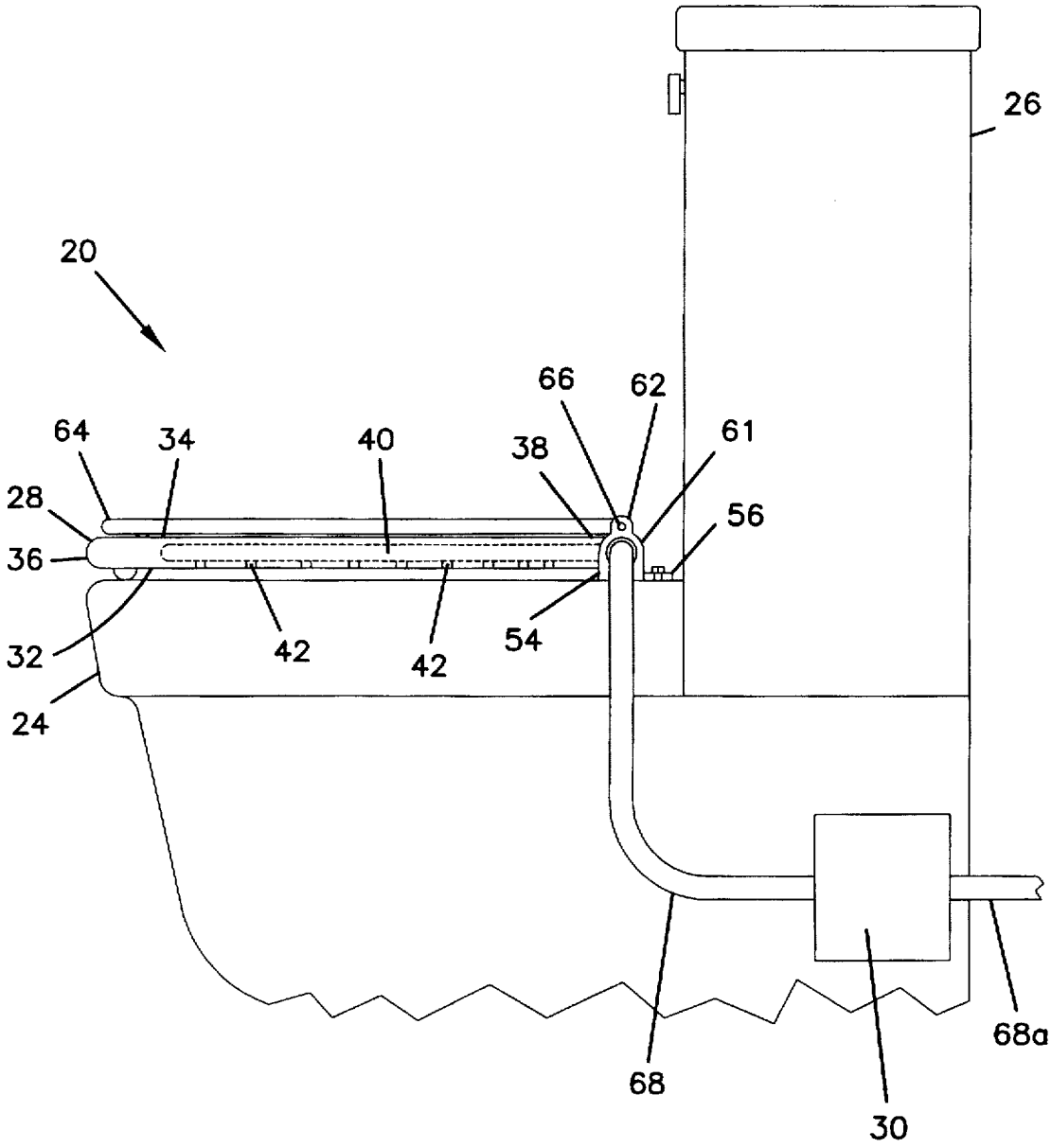
FIG. 1 is a side view of an exemplary toilet equipped with a ventilation system constructed in accordance with the principles of the present invention.

FIG. 1 shows a toilet 20 including a toilet ventilation system constructed in accordance with the principles of the present invention. The toilet 20 includes a toilet bowl 24 fluidly connected to a water tank 26 by conventional techniques. A toilet seat 28 is pivotally mounted on the toilet bowl 24. A source of vacuum 30 such as a fan or a pre-existing vent within a building is fluidly connected to the toilet seat 28. The toilet seat 28 and the source of vacuum 30 cooperate to ventilate the toilet bowl 24 by withdrawing air from the interior of the toilet bowl 24.

The toilet seat 28 of the toilet ventilation system has a bottom surface 32 positioned opposite from a top surface 34 and also includes a front end 36 positioned opposite from a back end 38. The back end 38 of the toilet seat 28 is pivotally connected to the toilet bowl 24 so as to allow the toilet seat to be moved between a raised position and a lowered position. When the toilet seat 28 is in the lowered position, the top surface 34 is arranged to provide a seating surface and the bottom surface 32 is arranged to face the interior of the toilet bowl 24.

Figure 2:
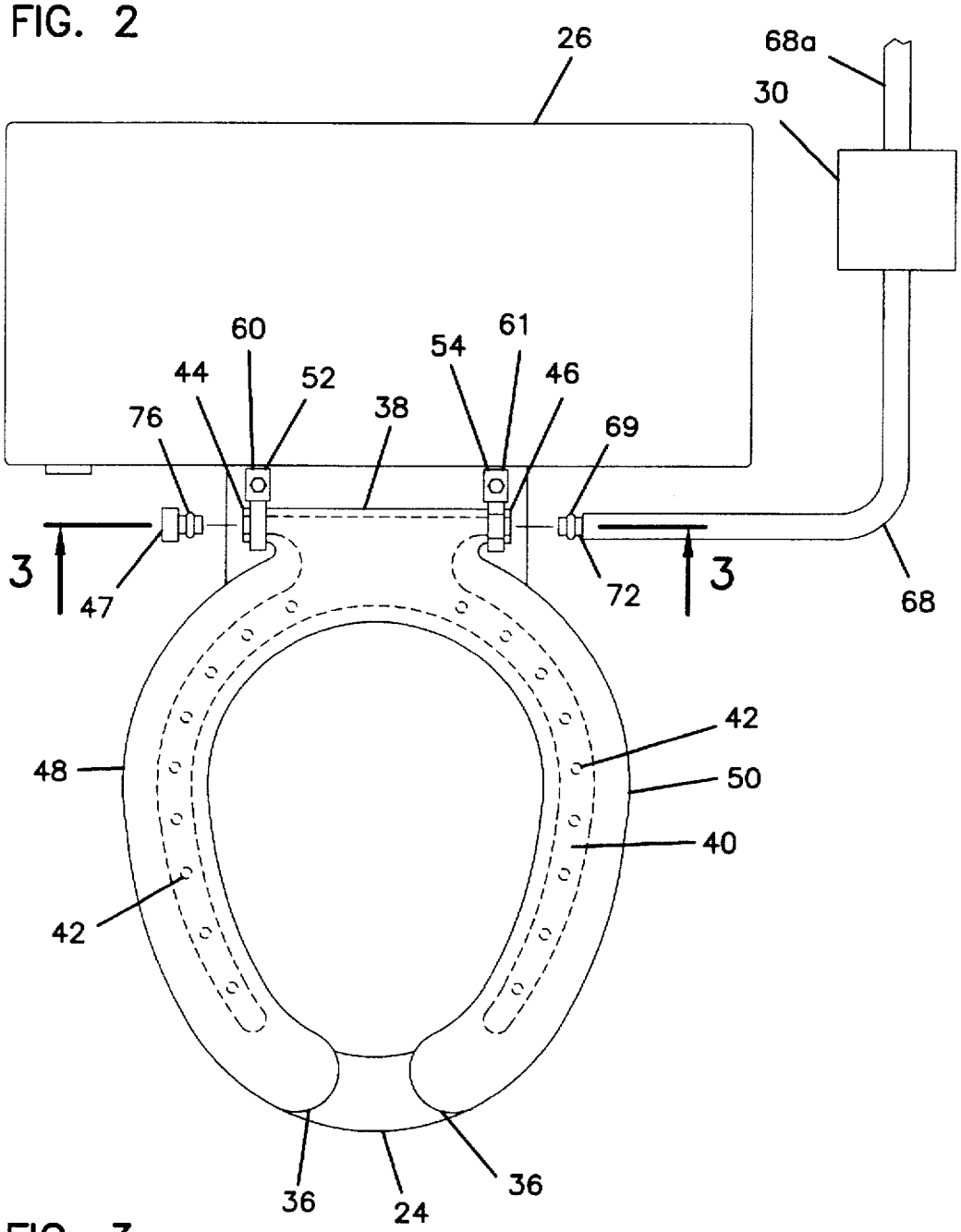
FIG. 2 is a top view of the toilet of FIG. 1 shown with the lid removed to facilitate viewing of the toilet seat.

The toilet seat 28 includes an inner duct 40 formed within the toilet seat 28 between the bottom and top surfaces 32 and 34. As shown in FIG. 2, the inner duct 40 has a generally horseshoe shaped configuration and extends generally between the back and front ends 36 and 38 of the toilet seat 28. The toilet seat 28 also defines a plurality of ventilation apertures 42 that extend between the inner duct 40 and the bottom surface 32 of the toilet seat 28. The ventilation apertures 42 provide fluid communication between the interior of the toilet bowl 24 and the inner duct 40 of the toilet seat 28.

The toilet seat 28 further includes left and right generally co-axially aligned pivot members 44 and 46 that are preferably unitarily formed with the back end 38 of the toilet seat 28. The left pivot member 44 preferably extends laterally outward from a left side 48 of the toilet seat 28 while the right pivot member 46 preferably extends laterally outward from a right side 50 of the toilet seat 28. The left and right pivot members 44 and 46 each define axial openings in fluid communication with the inner duct 40 of the toilet seat 28.

The toilet seat 28 is preferably pivotally connected to the toilet bowl 24 by a pair of left and right mounting brackets 52 and 54. The left and right mounting brackets 52 and 54 include structure defining left and right pivot holes 56 and 58 through which the left and right pivot members 44 and 46 respectively extend to pivotally mount the toilet seat 28 on the toilet bowl 24. The mounting brackets 52 and 54 also include left and right base flange portions 60 and 61 for connecting the mounting brackets 52 and 54 to the toilet bowl 24. Conventional fastening structures such as screws or bolts preferably extend through the base flange portions 60 and 61 and engage the toilet bowl 24 to rigidly fasten the mounting brackets 52 and 54 to the toilet bowl 24. The left and right mounting brackets 52 and 54 also preferably include upper tab portions 62 for pivotally mounting a lid 64 above the toilet seat 28. The upper tab portions 62 define secondary pivot holes 66 that pivotally receive lateral projections (not shown) formed at the back side of the lid 64 such that the lid 64 is pivotally mounted between the left and right mounting brackets 52 and 54.

FIG. 2 shows a ventilation conduit 68 providing fluid communication between the axial opening of the right pivot member 46 and the source of vacuum 30. A removable plug 47 is shown being inserted within the axial opening of the left pivot member 44. Although the removable plug 47 is shown being inserted in the left pivot member 44 and the ventilation conduit is shown being connected to the right pivot member 46, it will be appreciated that the orientation of the removable plug 47 and the ventilation conduit 68 could be reversed in order to facilitate retrofitting the toilet bowl 24.

Figure 3:
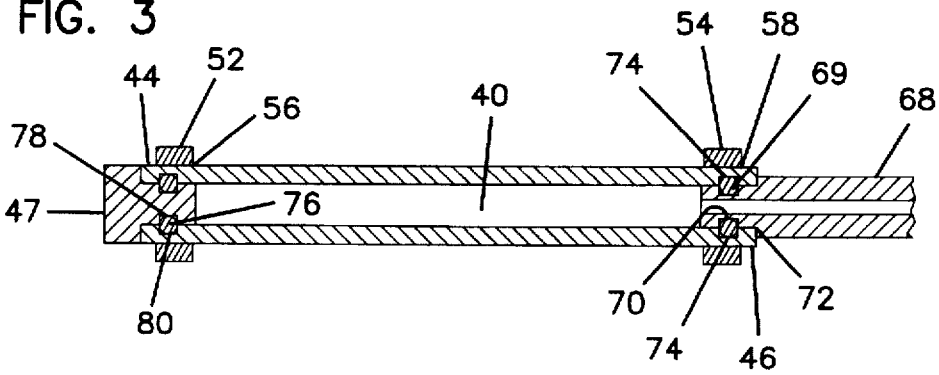
FIG. 3 is a cross sectional view of FIG. 2 taken along section line 3—3.

In order to allow the toilet seat 28 to pivot relative to the ventilation conduit 68, a swivel structure is utilized to provide a generally fluid tight connection between the ventilation conduit 68 and the right pivot member 46. As shown in FIGS. 2 and 3, the swivel structure includes a sealing structure such as a rubber O-ring 69. The rubber O-ring 69 is shown mounted within a first outer annular groove 70 that circumferentially surrounds a reduced diameter portion 72 of the ventilation conduit 68. The reduced diameter portion 72 has an outer diameter that is slightly smaller than the inner diameter of the right pivot member 46 such that the reduced diameter portion 72 can be inserted within the axial opening of the right pivot member 46. The right pivot member 46 defines a first inner annular groove 74 arranged to oppose the first outer annular groove 70 of the ventilation conduit 68. When the reduced diameter portion 72 is inserted in the right pivot member 46, the rubber O-ring 69 is captured between the reduced diameter portion 72 of the ventilation conduit and the right pivot member 46 and held within the inner and outer annular grooves 70 and 74 to provide a pivotal connection between the ventilation conduit and the toilet seat 28.

A similar configuration is used to provide a fluid tight seal between the left pivot member 44 and the removable plug 47. An O-ring 76 is shown mounted within a second outer annular groove 78 circumferentially surrounding the plug 47. A second inner annular groove 80 is defined within the left pivot member 44. When the plug is inserted within the left pivot member 44, the O-ring 76 snaps within the inner and outer grooves 78 and 80 such that the plug is retained within the left pivot member 44.

In operation, the source of vacuum 30 provides vacuum or suction to the ventilation apertures 42. When the toilet seat 28 is in the lower position and the source of vacuum is activated, air from within the interior of the toilet bowl 24 is drawn into the inner duct 40 through the ventilation apertures 42. Once in the duct, the air is drawn toward the back end 38 of the toilet seat 28 by the source of vacuum. Next, the air exits the inner duct 40 through the axial opening in the right pivot member 46. From the right pivot member 46, the air is carried through the ventilation conduit toward the source of vacuum. Eventually, the air is conveyed to an end destination such as the outside atmosphere or an existing ventilation system within a given building through a discharge tube 68*a*.

It will be appreciated that it may be desirable to sell the ventilation system 22 in a kit suitable for retrofitting a toilet bowl. It is preferred for the kit to be enclosed by suitable packaging material and include the toilet seat 28, the left and right mounting brackets 52 and 54, bolts or screws for connecting the mounting brackets to the toilet bowl 24, the removable plug 47, the ventilation conduit, and O-rings 69 and 76. The kit would most likely also include the lid 64 to be mounted over the toilet seat 28.

The toilet ventilation system 22 can be easily used to retrofit an existing toilet bowl. For example, the toilet ventilation system 22 is installed by first bolting one of the mounting brackets, such as the right mounting bracket 54, to the toilet bowl 24. Next, the right pivot member 46 is inserted through the right pivot hole 58 in the right mounting bracket 54. The left pivot member 44 is then inserted through the left pivot hole 56 in the left mounting bracket 52 and the left mounting bracket is bolted to the toilet bowl 24. The installation is completed by snapping the removable plug within one of the left and right pivot members 44 and 46 and snapping the ventilation conduit in the other of the left and right pivot members 44 and 46.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is as follows:

1. A toilet ventilation system comprising:

a toilet bowl;

a toilet seat having a bottom surface positioned opposite from a top seating surface and a back end positioned opposite from a front end, the toilet seat defining an inner duct located within the toilet seat and a plurality of ventilation apertures extending between the inner duct and the bottom surface of the toilet seat, the toilet seat also having a left side opposite from a right side;

first and second generally co-axially aligned pivot members integral with the back end of the toilet seat, the first pivot member extending laterally outward from one of the left and right sides of the toilet seat, and the second pivot member extending laterally outward from the other of the left and right sides of the toilet seat, the first pivot member defining a first axial opening in fluid communication with the inner duct;

first and second bracket members fixedly connected to the toilet bowl, the first and second bracket members defining looped portions through which the first and second pivot members respectively extend to mount the toilet seat on the toilet bowl, the first and second pivot members being free to pivot with respect to the first and second bracket members such that the toilet seat is pivotally movable between a raised position and a lowered position;

a fixedly positioned ventilation conduit providing fluid communication between the first axial opening of the first pivot member and a source of vacuum; and a swivel structure providing a generally fluid tight connection between the fixedly positioned ventilation conduit and the first pivot member, the swivel structure being constructed and arranged to allow the first pivot member to pivotally rotate with respect to the ventilation conduit while maintaining the fluid tight connection.

2. The toilet ventilation system of claim 1, wherein the pivot members are unitarily formed as a one piece unit with the toilet seat.

3. The toilet ventilation system of claim 1, wherein the swivel structure comprises an O-ring captured within an inner annular groove defined by the first pivot member and an outer annular groove of the ventilation conduit.

4. The toilet ventilation system of claim 1, wherein the second pivot member defines a second axial opening in fluid communication with the inner duct, the second axial opening being enclosed by a removable plug inserted within the second pivot member.

* * * * *